US006102305A

United States Patent [19]

Chapman et al.

[11] Patent Number: 6,102,305

[45] Date of Patent: Aug. 15, 2000

[54] LINE MARKING APPLICATORS

[75] Inventors: Steven Chapman, Great Ouseburn; Richard Edwards, Pontefract; Catherine J. Ripley, Dewsbury; Roger John Peach, Knowle; Barrington Hares, Great Barr, all of United Kingdom

[73] Assignee: Illinois Tool Works, Inc., Glenview, Ill.

[21] Appl. No.: 09/117,398

[22] PCT Filed: Jan. 7, 1997

[86] PCT No.: PCT/GB97/00034

§ 371 Date: Feb. 25, 1999

§ 102(e) Date: Feb. 25, 1999

[87] PCT Pub. No.: WO97/30228

PCT Pub. Date: Aug. 21, 1997

[30] Foreign Application Priority Data

Feb. 14, 1996 [GB] United Kingdom ..... 9602995

[51] Int. Cl.[7] ..... B05B 1/28

[52] U.S. Cl. ..... 239/150

[58] Field of Search ..... 239/140, 146, 239/147, 149, 150, 151, 155, 156; 222/611.1, 178, 174, 608

[56] References Cited

U.S. PATENT DOCUMENTS

| | | | |
|---|---|---|---|
| D. 402,669 | 12/1998 | Chapman | 15/4 |
| 2,812,211 | 11/1957 | Gardner | 239/150 |
| 3,229,858 | 1/1966 | Lesh | 222/174 |
| 3,716,195 | 2/1973 | Silva | 222/375 |
| 3,794,217 | 2/1974 | Munchel | 222/174 |
| 3,871,557 | 3/1975 | Smrt | 239/150 |
| 4,099,482 | 7/1978 | Smrt | 222/174 |
| 4,895,304 | 1/1990 | Smrt | 239/150 |
| 5,749,522 | 5/1998 | Smrt | 239/71 |
| 5,836,519 | 11/1998 | Brown | 239/373 |

FOREIGN PATENT DOCUMENTS

| | | | |
|---|---|---|---|
| 0678624 | 10/1995 | European Pat. Off. | 239/150 |
| 1400446 | 4/1965 | France | 239/150 |
| 2152848 | 8/1995 | United Kingdom | 239/150 |

*Primary Examiner*—Patrick Brinson
*Assistant Examiner*—Jorge Bocanegra
*Attorney, Agent, or Firm*—Dean W. Russell; Kilpatrick Stockton LLP

[57] ABSTRACT

Wheeled applicators for marking lines on various surfaces are detailed. Each applicator may include a head adapted to receive an aerosol dispenser containing line-marking fluid and a spray nozzle with a normally-closed valve. The head and dispenser further may be disposable.

18 Claims, 6 Drawing Sheets

18
40
16
34
39
14
12
60
39
36
46
44
46
26
22
20
48
52
70
72
68

LINE MARKING APPLICATORS

BACKGROUND OF THE INVENTION

This invention relates to applicators for line marking on surfaces such as roads, car parks, factory floors and playing areas including gymnasium floors, basket ball courts, artificially-turfed and naturally-turfed playing fields and the like. Our European Patent Specification No. 0 678 624 A2 discloses a line marking applicator comprising a frame having an axle on which is journalled a pair of surface contacting wheels and a mounting for a marker fluid aerosol dispenser positioned on the frame so that, when fitted with an aerosol dispenser and in use, marker fluid can be sprayed between the wheels onto a surface, the width of the sprayed line being defined by the spacing between the wheels, each of the wheels having an integral inner surface extending contiguously from the axle to a rim having a smaller diameter than that of the wheel rim and which is axially inwardly offset from the wheel rim to provide a circumferential groove, preferably each wheel is provided with a tire, the diameter of which is greater than the diameter of the inner surface rim and which is axially offset from the inner surface rim to form the peripheral groove.

SUMMARY OF THE INVENTION

Patient Specifications GB 2,288,619 A (Rocol Limited); GB 2,164,983 A (Sharpliner Limited (United Kingdom)); GB 2,111,568 A (Texalon International Limited); GB 1,456,411 (Rocol Limited) and GB 1,448,634 (T J Smrt) all disclose line marking applicators of this type to be hand tools clearly constructed to be re-used many times, that is one applicator would be used time and time again with a large number of different aerosols, hereinafter referred to as "high volume use". The applicator is largely formed from metal and, for example, in any line marking applicator the width defining means, such as the above referred integral inner wheel surfaces, must act to prevent "over-sprayed" line marking fluid from running onto the surface and blurring the edge of the sprayed line. Usually, the width defining wheels are of a large enough diameter that over-sprayed line marking fluid dries sufficiently in a revolution so as not to run or drip. After operation of a high volume use line marking applicator, the dried over-sprayed marking fluid either has to be removed from the width defining means or the applicator has to be so designed that dried marking fluid does not accumulate in areas affecting width defining performance.

In addition, a significant proportion of line marking applicator users only need to mark a relatively short length of line, hereinafter referred to as "low volume users", such that the "line length" of a typical aerosol dispenser of line marking fluid, spraying approximately 75–110 meters of 55 mm wide line, would suffice. The cost of extant high volume use line marking applicator is too high for such low volume users.

It is an object of the present invention to provide disposable line marking applicator for low volume use. With such applicator the problem of build up of dried marking fluid either does not arise or is not significant. Additionally, the applicator does not need to be constructed as nearly as robustly as extant line marking applicator, enabling the applicator to be readily produced from inexpensive materials.

According to one aspect of the present invention, a line marking applicator head comprises a holder to hold an aerosol dispenser, the aerosol dispenser containing marking fluid and having a spray nozzle with a normally closed valve, a supporter to support the head in use to contact and readily move over a ground or surface upon which a line is to be sprayed, an actuator to operate the spray nozzle and means to define the width of sprayed line, wherein the line marking holder is specifically designed to non-releasably engage the aerosol dispenser, so that the line marking head and the aerosol dispenser constitute a disposable line marking applicator. By "disposable" is meant the construction of the line marker head components and the materials from which they are made are designed and chosen to be just sufficient for the use of a single aerosol. "Disposable" has the meaning:

1. designed for disposal after use: disposable cups.
2. available for use if needed: disposable assets.
3. something, such as a baby's nappy, that is designed for disposal.
4. (pl.) short for disposable goods.

and "disposable goods" the meaning:

consumer goods that are used up a short time after purchase, including perishables, newspapers, clothes, etc.

(see Collins Electronic English dictionary & thesaurus 1992 Ver. 1.5).

This low volume use line marking applicator can readily be distinguished from the high volume use line marking applicators disclosed in the above referred prior art patent specifications; wherein the concept of low volume use, disposable line marking applicator having a line marking head non-releasably attached to the aerosol dispenser is nowhere described or even intimated.

Patent specification FR-A-1,400,446 discloses a line marking applicator wherein a spray manifold may, after use, either be cleaned with solvent or a new one employed for each fresh use of the applicator. This is not the same as making the whole line marking head disposable, indeed it discloses no more than simply replacing the spray nozzle of an aerosol dispenser in known manner; it does not disclose a disposable line marking applicator having a line marking head non-releasably attached to the aerosol dispenser.

In an embodiment of this aspect of the present invention, the line marking head is adapted to engage the nozzle end of the aerosol.

According to another aspect, the present invention comprises in combination an aerosol dispenser and a line marking applicator head, wherein the line marking holder non-releasably engages the aerosol dispenser.

In a first embodiment, both the supporter and the width defining means are formed by a pair of wheels journalled to the line marking holder so that line marking fluid can be sprayed from the spray nozzle onto the ground or surface between the wheels, the separation of which defines the width of the sprayed line. No special provision has to be made for disposal/removal/accumulation of over-sprayed marking fluid as the applicator is single aerosol dispenser use and disposable so that the amount of dried marker fluid that may accumulate on the wheels inner surface does not materially affect sprayed line definition. The wheels may be simple rigid discs, with or without a tire.

In a second embodiment, the aerosol dispenser forms a load bearing part of the line marking applicator.

In a third embodiment, the line marking head has one part, specifically designed to non-releasably engage the nozzle end of and be retained on the aerosol dispenser body and another part longitudinally movable with respect to the aerosol dispenser and the nozzle actuator is a fixed stop in said another head part designed to contact the spray nozzle so that, in use, longitudinal pressure on the aerosol dispenser body will force the aerosol dispenser against the stop and open the nozzle valve. Reduction of longitudinal pressure will lift the aerosol nozzle in the line marking head by reaction against the nozzle stop and permit the nozzle valve to close.

A line marking applicator in accordance with the present invention, may be designed to fit extant aerosols or it may prove practical to design aerosols especially for low volume use.

There are several advantages to a line marking applicator in accordance with the present invention; one is that problems with over-sprayed width defining means in line definition, that can occur with high volume use applicators, is obviated; another is that the applicator cannot be used with the wrong aerosol dispenser; a further advantage is that the fit between the line marking head and the aerosol dispenser body an be optimised. Indeed, the surprising result of a line marking applicator in accordance with the present invention and having the line marking head non-releasably engaged with the nozzle end of the aerosol dispenser; is that a sprayed line having significantly better edge definition is obtained than the line definition produced by any extant line marking applicator known to the Applicant. It is thought that this is due to the geometry of spray nozzle position (with the nozzle valve open) with respect to the width defining wheels and the surface upon which the line is to be sprayed being more accurately controlled.

In a further embodiment of the present invention, a handle may be detachably attached to the other, top end of the aerosol dispenser.

In a preferred embodiment, the aerosol dispenser has a spring-loaded, normally closed valve and the line marking head is formed as a single integral unit, preferably a plastic moulding, one part of which is a non-releasablee, snap-fit on the nozzle end of the aerosol dispenser and has a clearance for the spray nozzle and a second part of which is shaped to be a stop engageable with the spray nozzle, to provide a clearance path for marker fluid when sprayed from the nozzle, and to carry a pair of surface-contacting line-width defining wheels; the two parts being joined to one another by a resilient hinge so that so that the two parts can move relative to one another whereby, in use, longitudinal pressure on the aerosol dispenser will cause said one part to move towards said second part such that the spray nozzle will bear against said second part to actuate and open the nozzle valve to thereby spray marker fluid down onto the surface between the wheels, release of longitudinal pressure on the aerosol dispenser will enable the nozzle valve spring and/or the resilient hinge to move the two parts apart and allow the nozzle valve to close.

BRIEF DESCRIPTION OF THE DRAWINGS

The above and other features of the present invention are illustrated, by way of example, in the Drawings: wherein.

DETAILED DESCRIPTION OF THE INVENTION

Figure 1:
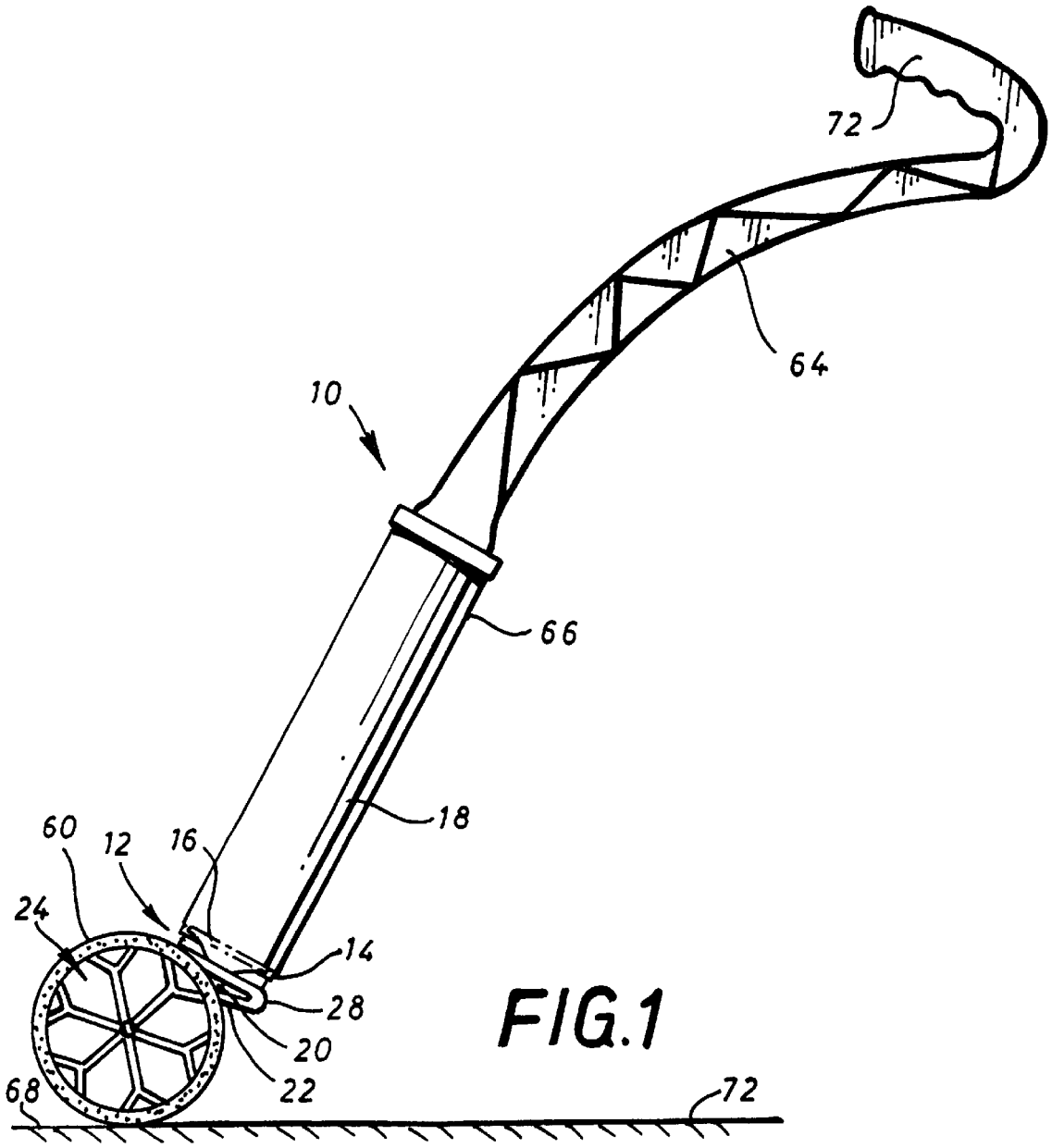
FIG. 1 is a side elevation of a line marking applicator in accordance with the present invention, fully assembled and in use.

As shown, disposable line marking applicator 10 comprises a line marking head 12 having one, upper, part 14 to engage, as a non-release snap-fit, with the nozzle end 16 of an inverted conventional aerosol dispenser 18, the aerosol dispenser containing line marker fluid and having a spray nozzle 20 with a spring-loaded normally closed valve. The head having a second, lower, part 22 shaped to include a stop engageable with the spray nozzle 20 and with a pair of wheels 24 and 26 journalled thereon; the two parts being joined together by an integral resilient hinge 28 so that they move towards and away from one another.

As can be seen most clearly from FIGS. 3 to 6, the line marking head 12 is a plastic resilient hinge 28 so that they may move towards and away from one another.

As can be seen most clearly from FIGS. 3 to 6, the line marking head 12 is a plastic moulding of, e.g. polypropylene or ABS, wherein the upper part 14 is generally rectangular with upstanding, curved end walls 30, each having an internal shoulder 32 shaped to abut the rim 34 of the aerosol end 16, and a central planar portion 36 having a central aperture 38 of a size to clear the spray nozzle 20 and provided with spaced, circumferentially extending, retaining collars 39 (FIG. 6) shaped to engage under the nozzle valve surround 40 as an interference, non-releasable, snap fit; retaining collars 39 are designed to resist removal of the line marking head from the aerosol 18 and make difficult replacement on another aerosol dispenser; as the engagement with the nozzle valve surround 40 requires the use of a pneumatic or hydraulic press tool. Upper part 14 is joined to lower part 22 by the hinge 28.

Figure 2:
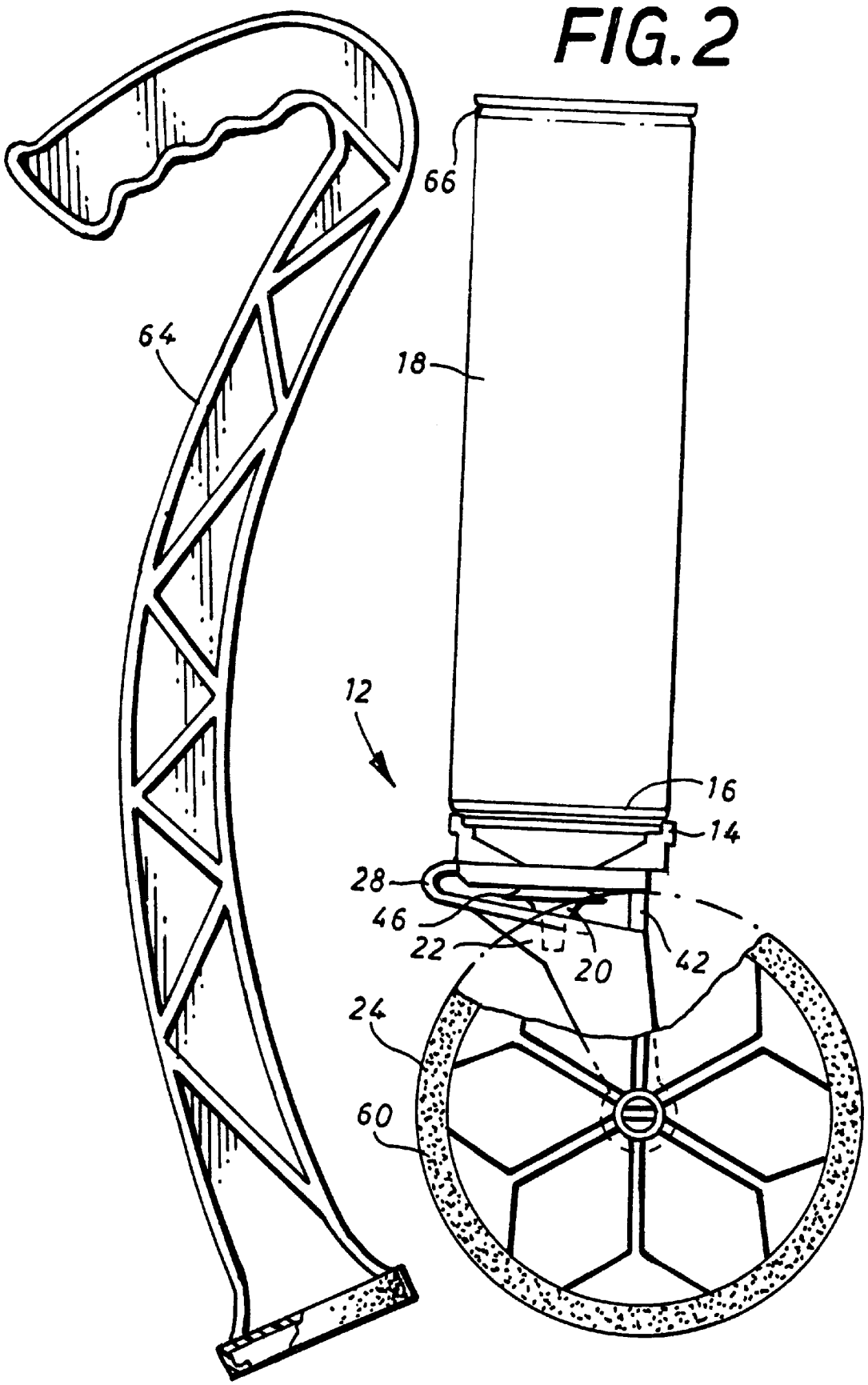
FIG. 2 is a side elevation of the applicator of FIG. 1, disassembled and prior to use.
Figure 3:
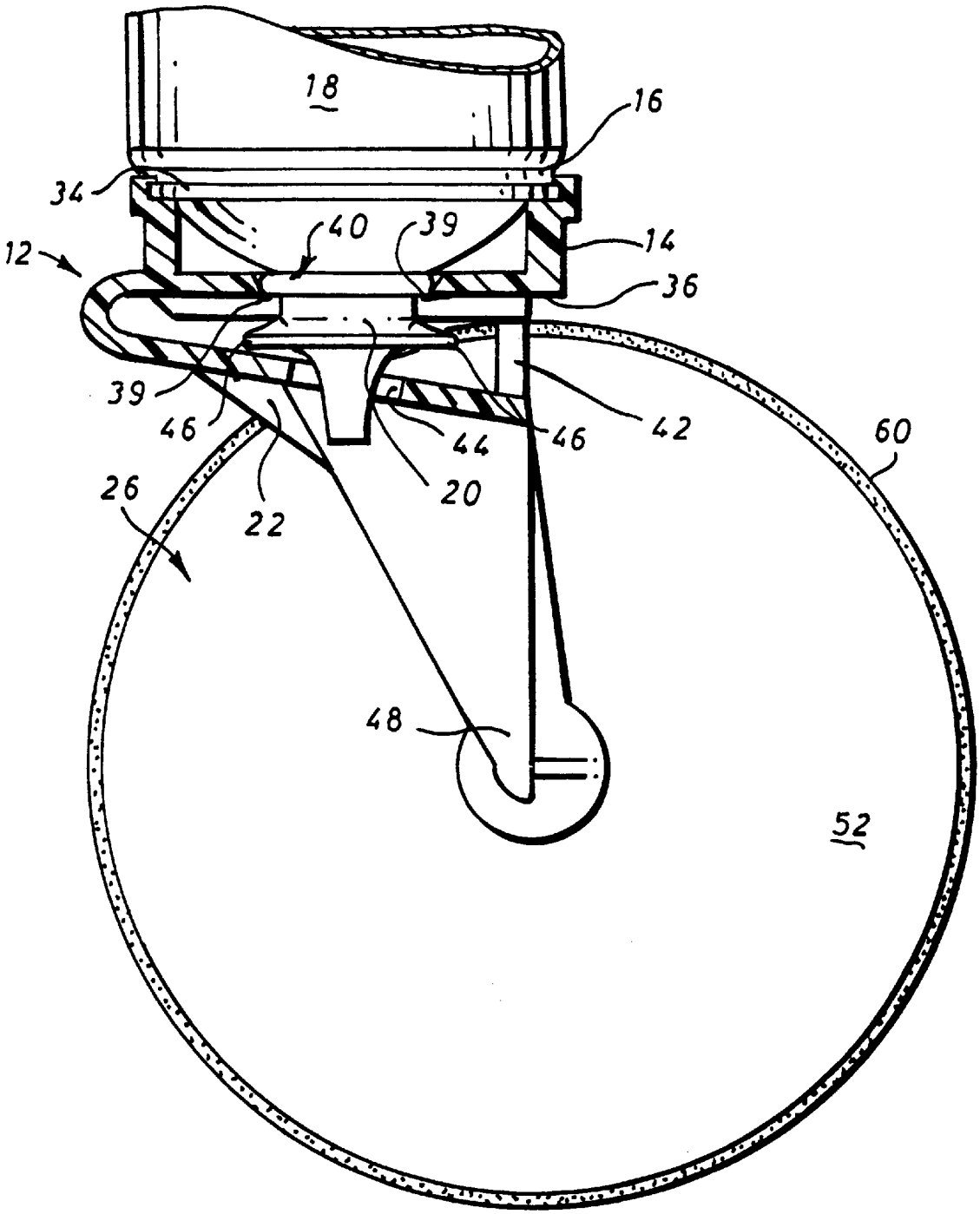
FIG. 3 is a detail, part-sectioned side elevation of the spray nozzle end with the attached line marking head of the applicator of FIG. 1.
Figure 4:
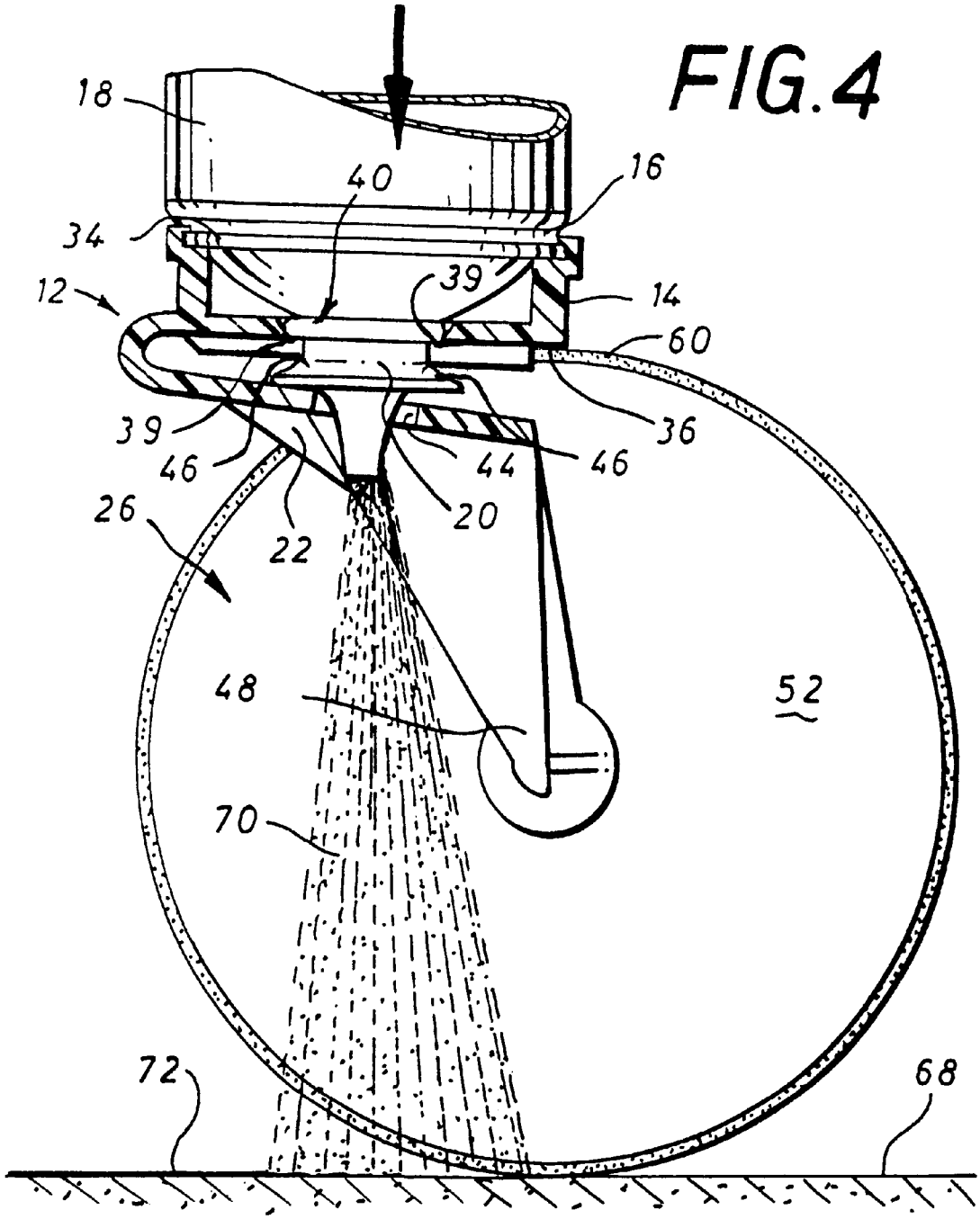
FIG. 4 is a similar view to that of FIG. 3, but with the aerosol dispenser axially pressed and the nozzle open and spraying marker fluid.
Figure 5:
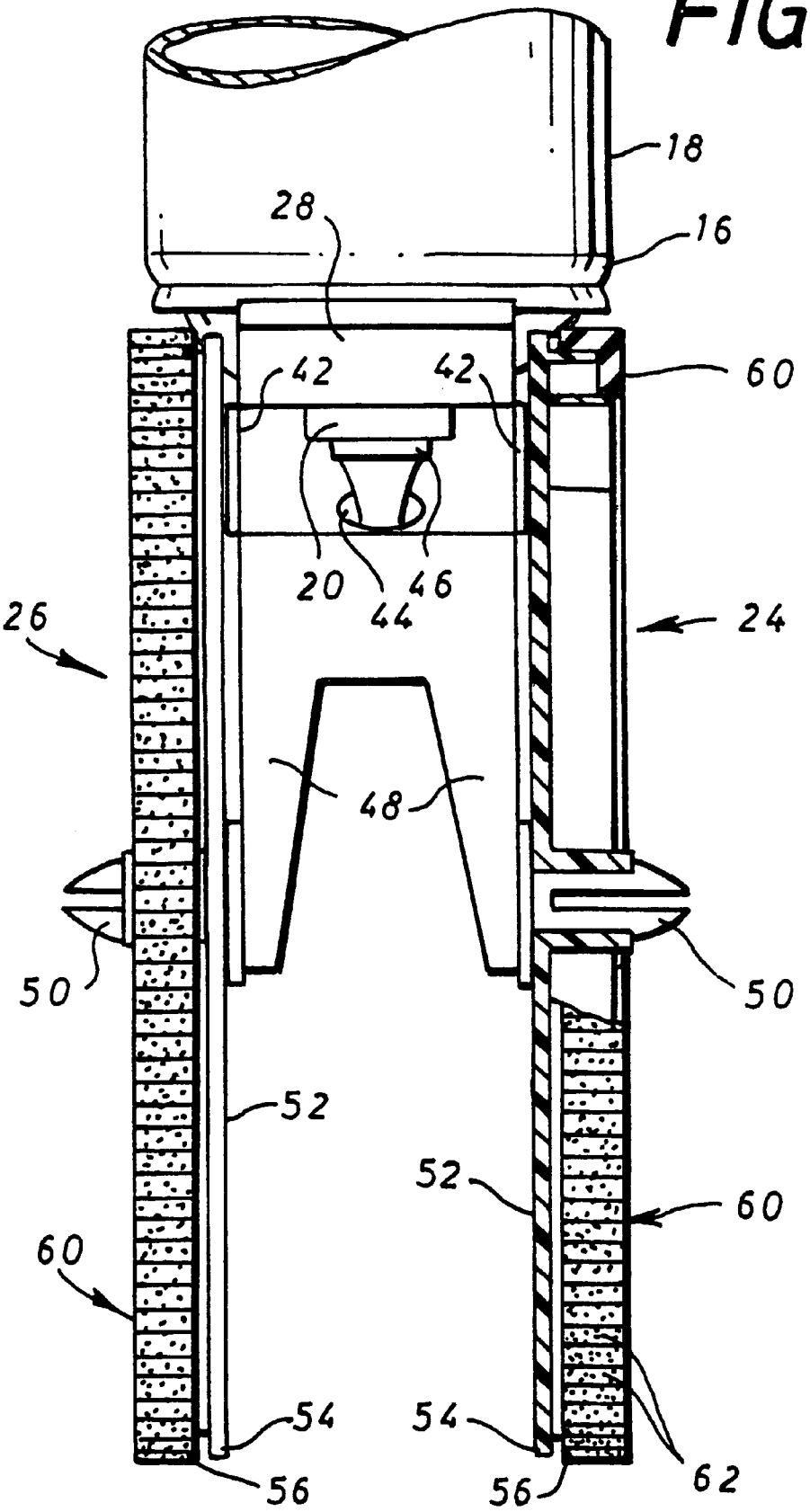
FIG. 5 is a detail, front elevation corresponding to FIG. 3.
Figure 6:
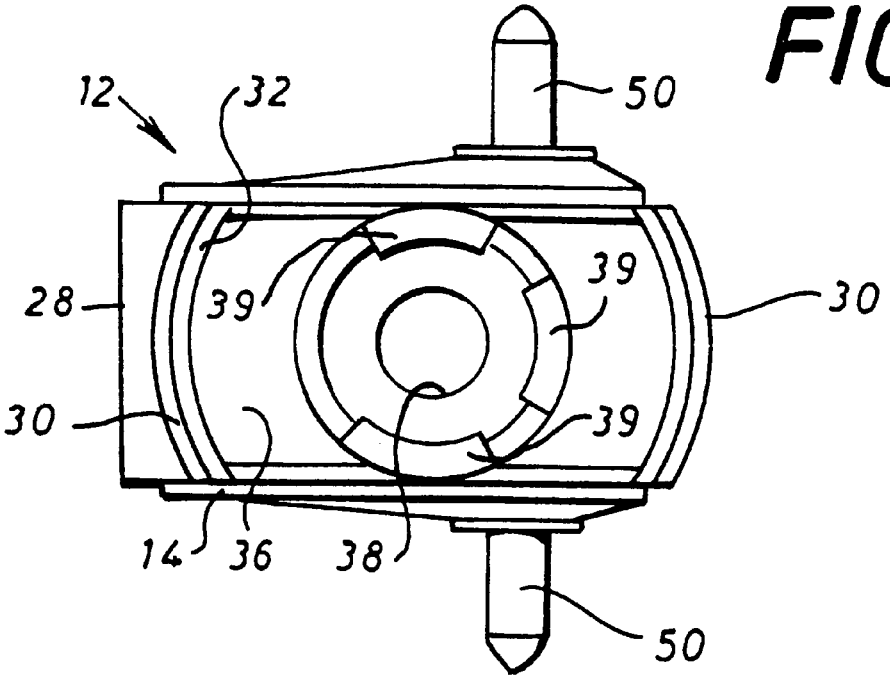
FIG. 6 is a plan of part of the line marking head.

Lower part 22 is again a generally rectangular plate with a central aperture 44 of a size to contact the spray nozzle 20; as shown the spray nozzle protrudes through this aperture but wings 46 carried by the spray nozzle can abut the lower part 22 on either side of aperture 44. A pair of forks 48 depend from the lower part 22, with each arm of the fork terminating in an out-turned, split-ended stub shaft 50 on which a respective wheel 24, 26 is journalled as a snap-on fit. Lower part 22 also carries a pair of upstanding, snap-off stops 42 (see FIG. 2) that abut the underside of upper part 14; the stops 42 prevent the head parts from closing and opening the aerosol nozzle valve, thereby preventing accidental spray of marker fluid.

Figure 7:
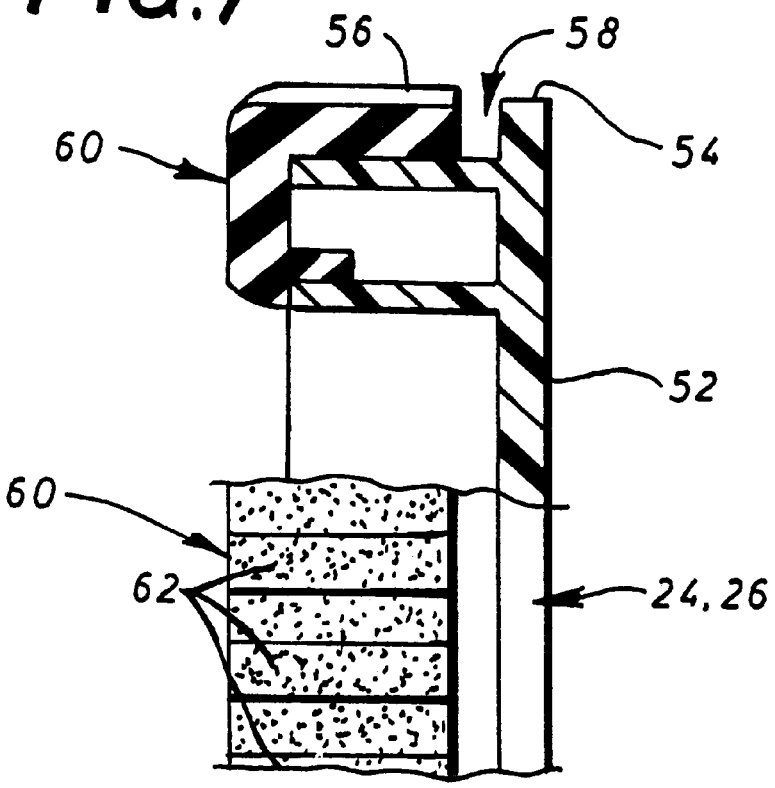
FIG. 7 is a detail, part-sectioned elevation of a wheel and tire.

The wheels 24, 26 (see FIGS. 5 and 7) are of the same general type as described in our European Patent Specification No 0 678 624 A2 and are each a plastics moulding of, for example, polypropylene, ABS or polyester and have an integral inner surface 52 extending continuously from the stub axle 50 to a rim 54, that has a smaller diameter than that of the wheel rim 56 and which is axially inwardly offset from the wheel rim to provide a circumferential groove 58. Each wheel is provided with a tire 60, the diameter of which is greater than the diameter of the inner surface rim and which is axially offset from the inner surface rim to form the peripheral groove 58. The tires 60 are moulded with a tread pattern A handle 64 is also provided and is another plastic moulding, this time designed as a releasable snap-fit on to the other, top end 66 of the aerosol dispenser 18.

The applicator is sold in two separate components (see FIG. 2), comprising the line marking head attached to an aerosol dispenser and the handle, so that it can be contained in a pack of convenient size.

In use, the handle 64 will be snapped onto the aerosol dispenser end 66, the stops 42 are snapped off and longitudinal pressure (in the direction of the arrow in FIG. 4) will force the head 12 down against the wheels 24, 25; the line marking head hinge 28 resiliently yields to permit the spray nozzle wings to abut the line marking head lower part and open the nozzle valve. The applicator can then be wheeled along a surface 68 with a conical spray 70 of marker fluid emerging from the spray nozzle 20 to leave a line 72 on the surface (see FIGS. 1 and 4). The width of the line is defined by the separation between the two wheels 24, 26; the spray pattern intercepting the wheel inner surfaces 52 with over-sprayed marker fluid continuously being carried away from the surface 68 as the wheels rotate, to leave a clearly defined, straight edged line 72. Release of longitudinal pressure will enable the two parts 14, 22 of the line marking head to separate, freeing the spray nozzle and permitting the aerosol nozzle valve to close.

The wheel forks 48 of the line marker head 12 leave a clear, drip-less spray path and, as previously stated results, in a very good definition of sprayed line 72, significantly better than conventional line marking appliances having width defining wheels on a common axle.

The handle is curved between its end attached to the aerosol dispenser end 66 and its hand grip 74 so that longitudinal pressure, in use, is naturally directed behind the contact between the wheels 24, 26 and the ground 68; this ensures that the applicator will roll smoothly over the ground without tending to stop when the applicator wheels meet an obstruction and thus spoil the evenness of the sprayed line.

The applicator can be used repeatedly until the supply of marker fluid in the aerosol dispenser has been evaluated. The applicator is then finished with and can be disposed of; the plastic handle being unsnapped and recycled and the line marking head being broken off the aerosol dispenser for separate recycling.

What is claimed is:

1. A line marking applicator head comprising a holder specifically designed to non-releasably engage an aerosol dispenser, the aerosol dispenser comprising a container with a normally closed nozzle valve and including a propellant gas under pressure to discharge line marking fluid contained therein as a spray through the nozzle, a supporter to support the head in use to contact and readily move over a ground or surface upon which a line is to be sprayed, an actuator to operate the spray nozzle and means to define the width of the sprayed line; the line marking head and the aerosol dispenser together constituting a disposable line marking applicator.

2. A head as claimed in claim 1, wherein the line marking holder is specially designed to non-releasably engage the nozzle end of the aerosol dispenser.

3. A head as claimed in claim 2, wherein a handle is detachably attachable directly to the other, non-nozzle end of the aerosol dispenser.

4. A head as claimed in claim 1, wherein both the supporter and the width defining means are formed by a pair of wheels journalled to the line marking holder so that line marking fluid can be sprayed from the spray nozzle onto the ground or surface between the wheels, the separation of which defines the width of the sprayed line.

5. A head as claimed in claim 1 and having a first part designed to non-releasably engage the nozzle end of and be retained on the aerosol dispenser body and a second part longitudinally movable with respect to the aerosol dispenser and the nozzle actuator is a fixed stop in said second part designed to contact the spray nozzle so that, in use, longitudinal pressure on the aerosol dispenser body will force the aerosol dispenser against the stop and open the nozzle valve.

6. A head as claimed in claim 4 or claim 5, wherein the aerosol dispenser has a spring-loaded, normally closed nozzle valve and the line marking holder and the nozzle actuator are formed as a single integral plastic molding, a first part of which is a non-release, snap-fit on the nozzle end of the aerosol dispenser and has a clearance for the spray nozzle, and a second part of which is shaped to be engageable with the spray nozzle, to provide a clearance path for marker fluid when sprayed from the nozzle, and to carry the pair of surface-contacting, line-width defining wheels; the two parts being joined to one another by a resilient hinge so that the two parts can move relative to one another whereby, in use, longitudinal pressure on the aerosol dispenser will cause said first part to move towards said second part such that the spray nozzle will bear against said second part to actuate and open the nozzle valve to thereby spray marker fluid between the wheels down onto a surface, release of pressure on the aerosol dispenser will enable the two parts to move apart and allow the nozzle valve to close.

7. A head as claimed in claim 5, wherein the line marking head has a removable stop to prevent accidental opening of the nozzle valve.

8. A head as claimed in claim 7, wherein the lower part of the line marking head carries a pair of upstanding, snap-off stops that abut the underside of upper part; the stops preventing the two head parts from closing and thereby opening the spray nozzle valve.

9. A head as claimed in claim 4, wherein the line marking head does not have any structure in or near the path of marker fluid when sprayed from the nozzle save for the opposed inner surfaces of the width defining wheels.

10. In combination an aerosol dispenser comprising a container with a normally closed nozzle valve and including a propellant gas under pressure to discharge line marking fluid contained therein as a spray through the nozzle and a line marking head comprising a holder non-releasably engaged to the aerosol dispenser, a supporter to support the head in use to contact and readily move over aground or surface upon which a line is to be sprayed, an actuator to operate the spray nozzle and means to define the width of sprayed line; the line marking head and aerosol dispenser together constituting a disposable line marking applicator.

11. A combination as claimed in claim 10, wherein both the supporter and the width defining means are formed by a pair of wheels journalled to the line marking holder so that line marking fluid can be sprayed from the spray nozzle onto the ground or surface between the wheels, the separation of which defines the width of the sprayed line.

12. A combination as claimed in claim 10, wherein the aerosol dispenser forms a load bearing part of the line marking applicator.

13. A combination as claimed in claim 10, wherein the line marking head has a first part designed to non-releasably engage the nozzle end of and be retained on the aerosol dispenser body and a second part longitudinally movable with respect to the aerosol dispenser, and the nozzle actuator is a fixed stop in said second part designed to contact the spray nozzle so that, in use, longitudinal pressure on the aerosol dispenser body will force the aerosol dispenser against the stop and open the nozzle valve.

14. A combination as claimed in claim 10 or claim 11, wherein the aerosol dispenser has a spring-loaded, normally closed nozzle valve and the line marking holder and the nozzle actuator are formed as a single integral plastic molding, a first part of which is a non-release, snap-fit on the nozzle end of the aerosol dispenser and has a clearance for the spray nozzle, and a second part of which is shaped to be engageable with the spray nozzle, to provide a clearance path for marker fluid when sprayed from the nozzle, and to carry the pair of surface-contacting, line-width defining wheels; the two parts being joined to one another by a resilient hinge so that the two parts can move relative to one another whereby, in use, longitudinal pressure on the aerosol dispenser will cause said first part to move towards said second part such that the spray nozzle will bear against said second part to actuate and open the nozzle valve to thereby spray marker fluid between the wheels down onto a surface, release of pressure on the aerosol dispenser will enable the two parts to move apart and allow the nozzle valve to close.

15. A combination as claimed in claim 13, wherein the line marking head has a removable stop to prevent accidental opening of the nozzle valve.

16. A combination as claimed in claim 15, wherein lower part of the line marking head carries a pair of upstanding, snap-off stops that abut the underside of upper part; the stops preventing the two head parts from closing and thereby opening the spray nozzle valve.

17. A combination as claimed in claim 11, wherein the line marking head does not have any structure in or near the path of marker fluid when sprayed from the nozzle save for the opposed inner surfaces of the width defining wheels.

18. A disposable line marking applicator head adapted in use to receive an aerosol dispenser containing line marking fluid and a spray nozzle with a normally-closed valve, the head comprising:

a. means for non-releasably engaging the aerosol dispenser;

b. means, in use contacting and readily moving over a surface upon which a line is to be sprayed, for supporting the head;

c. means for actuating in use the spray nozzle to spray a line;

d. means for defining in use the width of the sprayed line.

* * * * *